US006682468B2

(12) United States Patent
Lauderbaugh

(10) Patent No.: US 6,682,468 B2
(45) Date of Patent: Jan. 27, 2004

(54) ROTATING SCORING HEAD WITH CURVILINEAR NIB

(75) Inventor: David Lauderbaugh, Roswell, GA (US)

(73) Assignee: Corrugated Gear & Services, Inc., Alpharetta, GA (US)

( * ) Notice: Subject to any disclaimer, the term of this patent is extended or adjusted under 35 U.S.C. 154(b) by 106 days.

(21) Appl. No.: 09/992,020

(22) Filed: Nov. 26, 2001

(65) Prior Publication Data

US 2003/0084775 A1 May 8, 2003

Related U.S. Application Data

(60) Provisional application No. 60/338,022, filed on Nov. 7, 2001.

(51) Int. Cl.[7] ..... B31B 1/25

(52) U.S. Cl. ..... 493/59; 493/60; 493/64; 493/396; 493/403

(58) Field of Search ..... 493/403, 59, 60, 493/64, 396, 402

(56) References Cited

U.S. PATENT DOCUMENTS

| | | | | |
|---|---|---|---|---|
| 3,314,339 A | | 4/1967 | Guffy et al. | |
| 3,318,206 A | | 5/1967 | Kuehn et al. | |
| 3,917,254 A | * | 11/1975 | Watrous | 493/399 |
| 4,289,492 A | * | 9/1981 | Simpson | 493/371 |
| 4,725,261 A | * | 2/1988 | Millard et al. | 493/82 |
| 5,393,295 A | * | 2/1995 | Knecht | 493/403 |
| 5,509,885 A | * | 4/1996 | Brunlid | 493/396 |
| 5,823,935 A | * | 10/1998 | Puhl | 493/354 |
| 5,873,807 A | | 2/1999 | Lauderbaugh et al. | |

FOREIGN PATENT DOCUMENTS

| | | | | |
|---|---|---|---|---|
| JP | 2-277620 | * | 4/1989 | B31B/1/25 |

* cited by examiner

*Primary Examiner*—Allan N. Shoap
*Assistant Examiner*—John Windmuller
(74) *Attorney, Agent, or Firm*—Mehrman Law Office, PC; Michael J. Mehrman

(57) ABSTRACT

A scoring head configured for rotating about an axis of rotation and impressing score lines into corrugated board. The scoring head includes an inner wheel portion extending axially along an axis of rotation, extending radially about the axis of rotation, and defining first and second radial edges. The scoring head also includes a scoring edge portion located at an axially outer edge of the inner wheel portion and faired into the first and second radial edges of the inner wheel portion. The scoring edge portion, when viewed in cross-section, includes a substantially axial tier located between two substantially radial sides. The scoring edge portion also includes a curvilinear nipple shaped nib faired into the radial sides of the axial tier and faired into the first and second radial edges of the inner wheel portion. The nib may also include a base portion faired into the first and second radial edges and a bottle nose-shaped portion faired into the base. The nib may include a plurality of arcuate segments defining the nipple shaped curvilinear nib portion of the scoring head.

12 Claims, 6 Drawing Sheets

ROTATING SCORING HEAD WITH CURVILINEAR NIB

This application claims benefit to Provisional Application 60/338,022 filed Nov. 7, 2001.

TECHNICAL FIELD

This invention relates generally to the corrugated board industry and, more particularly, relates to a corrugated board scoring head having a scoring edge having a curvilinear nib profile.

BACKGROUND OF THE INVENTION

For many decades, scoring heads have been used to impress score lines into corrugated board to facilitate folding the board into desired configurations, such as boxes. Proper score lines should be "crisp" in that the board immediately adjacent to the score line is not bent or rolled toward the score line. In addition, the scoring head should not tear, crack or cut the top liner of the board. A board with a "rolled" score line or torn, cracked or cut liner is weaker than a board with a crisp score line, and may be considered defective for many applications.

Despite many years of industry experience, conventional scoring heads still produce an unacceptable number of defective "rolled" score lines and torn, cracked or cut liners. These problems can be accentuated when the same scoring head is used to score corrugated board of varying thickness, such as single-wall, double-wall and triple-wall board. For example, a scoring head that effectively creates crisp score line in double-wall board may produce rolled score lines in single-wall board. Conversely, a scoring head that effectively creates create crisp score lines in single-wall board may tear, crack or cut the top liner when used on double-wall board. In general, a single scoring head that effectively creates crisp score lines in single-wall, double-wall and triple-wall board is not presently available. For this reason, the scoring heads often must be changed in response to changes in board thickness. Of course, changing the scoring heads, which slows production, is inconvenient and costly.

Therefore, there is a continuing need in the corrugated board industry for a scoring head that consistently creates crisp score lines in corrugated board of varying thickness, such as single-wall, double-wall and triple-wall board.

SUMMARY OF THE INVENTION

The present invention meets the needs described above in a scoring edge having a curvilinear nib profile. The scoring head may be symmetrical about a central axis. The curvilinear nib profile of the scoring head allows the head to consistently create crisp score lines in corrugated board of varying thickness, such as single-wall, double-wall and triple-wall board. That is, the curvilinear nib scoring head profile effectively avoids tearing, cracking or cutting the top liner, or creating rolled score lines, when used on corrugated board of varying thickness. Therefore, the same scoring head can be used to score single-wall, double-wall and triple-wall board.

Generally described, the invention includes a scoring head configured for impressing score lines into corrugated board. The scoring head includes an inner wheel portion and a scoring edge portion located at an outer edge of the inner wheel portion. The scoring edge, which is faired into the inner wheel portion, defines a curvilinear nib that is generally nipple shaped.

More specifically, the nipple shaped nib may include a base portion faired into the inner wheel portion. The nib may also include a bottle nose-shaped portion faired into the base portion. In addition, the scoring edge portion may include a central protuberance faired into the bottle nose-shaped portion of the nib.

Stated somewhat more specifically, the scoring head includes an inner wheel portion and a scoring edge portion located at an outer edge of the inner wheel portion and faired into the inner wheel portion. The scoring edge portion, when viewed in cross-section, includes a substantially axial tier located between two substantially radial sides. The scoring edge portion also includes a curvilinear nipple shaped nib faired into the radial sides of the axial tier and faired into the inner wheel portion.

Further defined, the nib may include a first arcuate segment extending about a first radius of rotation pointed in an axially inward and radially inward direction, and the radial side of the central protuberance may be faired into the first arcuate segment. The nib may include a second arcuate segment extending about a second radius of rotation pointed in an axially inward and radially outward direction, and the first arcuate segment is faired into the second arcuate segment. The nib may include a third arcuate segment extending about a third radius of rotation pointed in an axially inward and radially inward direction, and the second arcuate segment may be faired into the third arcuate segment. The nib may include a fourth arcuate segment extending about a fourth radius of rotation pointed in an axially outward and radially outward direction, and the fourth arcuate segment is faired into the third arcuate segment and faired into the inner wheel portion.

In various embodiments, the first radius of rotation may be smaller in magnitude than the fourth radius of rotation, the first radius of rotation may be smaller in magnitude than the second and third radii of rotation, the first and fourth radii of rotation are smaller in magnitude than the second and third radii of rotation. Alternatively, the first radius of rotation may be smaller in magnitude than the fourth radius of rotation, and the fourth radius of rotation may be smaller in magnitude than the second and third radii of rotation. Or the first radius of rotation may be smaller in magnitude than the fourth radius of rotation, and the fourth radius of rotation may be smaller in magnitude than the second radius of rotation.

The specific configuration of a preferred embodiment of the scoring head will become apparent from the following detailed description and the appended drawings and claims. Many other variations, which will be apparent to those skilled in the art, fall within the scope of the present invention as defined by the claims at the end of this specification.

DETAILED DESCRIPTION OF THE EMBODIMENTS

Figure 1:
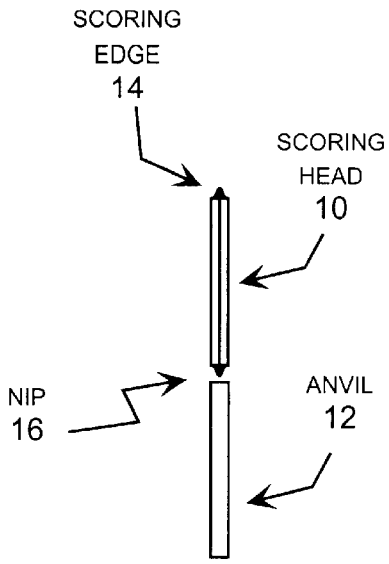
FIG. 1 is a front view of a scoring head and anvil for impressing score lines into corrugated board.
Figure 2:
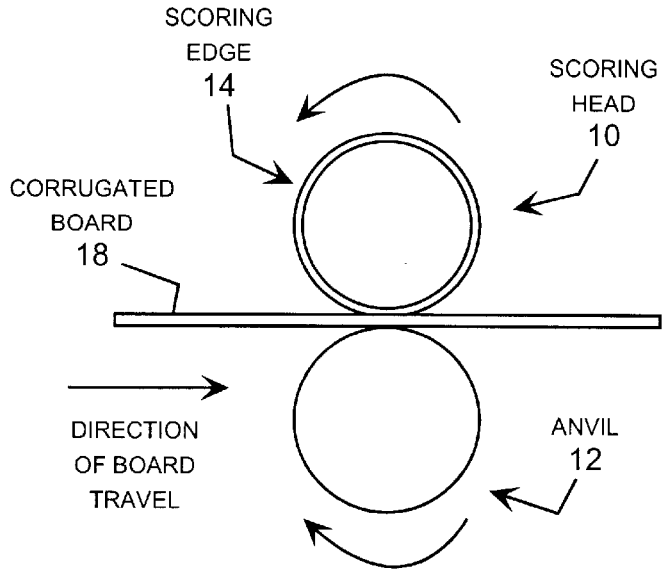
FIG. 2 is a side view of a scoring head and anvil for impressing score lines into corrugated board.
Figure 3:
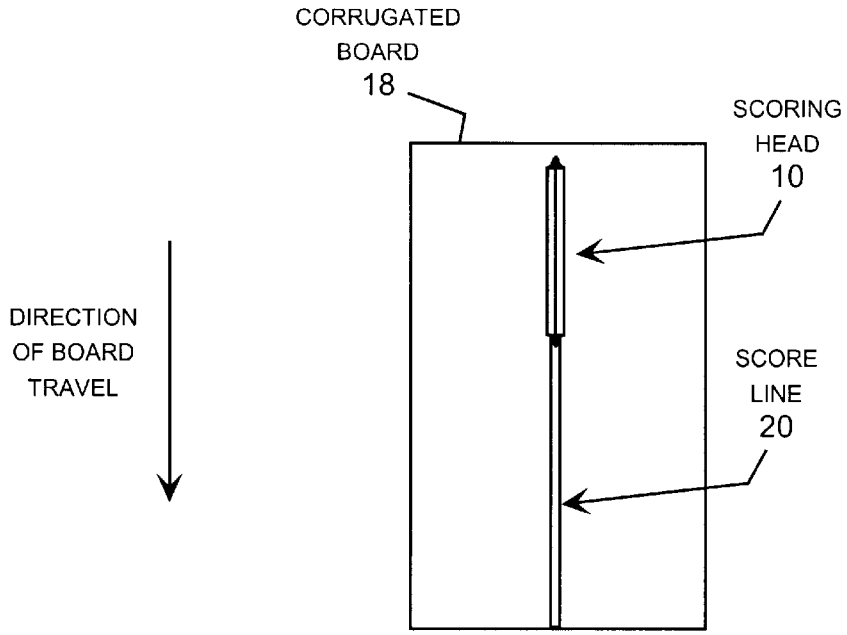
FIG. 3 is a top view of a scoring head and anvil for impressing score lines into corrugated board.
Figure 4:
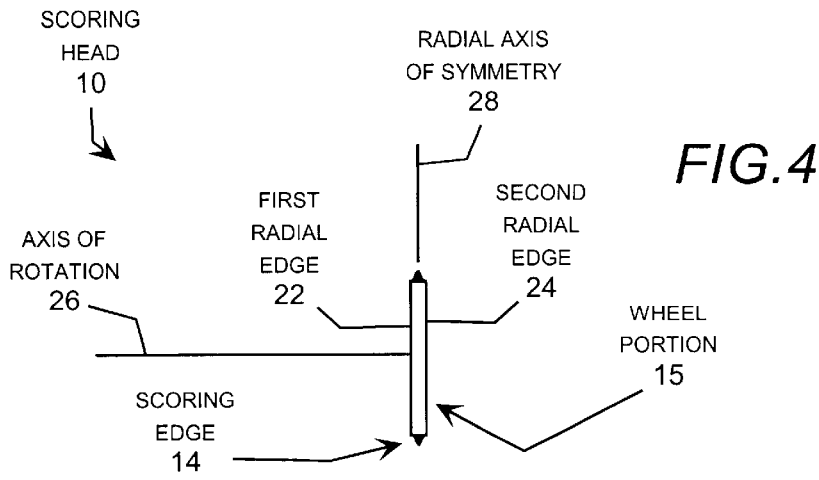
FIG. 4 is a front view of a scoring head for impressing score lines into corrugated board.

Turning now to the drawings, in which like numerals refer to like elements throughout the several figures, FIG. 1 is a front view of a scoring head 10 and anvil 12 for impressing score lines into corrugated board. FIG. 2 is a corresponding side view, and FIG. 3 is a corresponding top view. The scoring head 10 includes a scoring edge 14 for impressing a score line 20 into corrugated board 18 passing through a nip 16 between the scoring head 10 and anvil 12. FIG. 4 is a front view of the scoring head 10, which includes a scoring edge 14 located between a first radial edge 22 and a second radial edge 24. The scoring head 10 rotates about an axis of rotation 26, and is typically symmetrical about a radial axis of symmetry 28. Although the general features and operation of the scoring head 10 described above are well known in the art, the curvilinear nib profile of the scoring edge 14 represents a significant improvement in scoring head technology.

Figure 5:
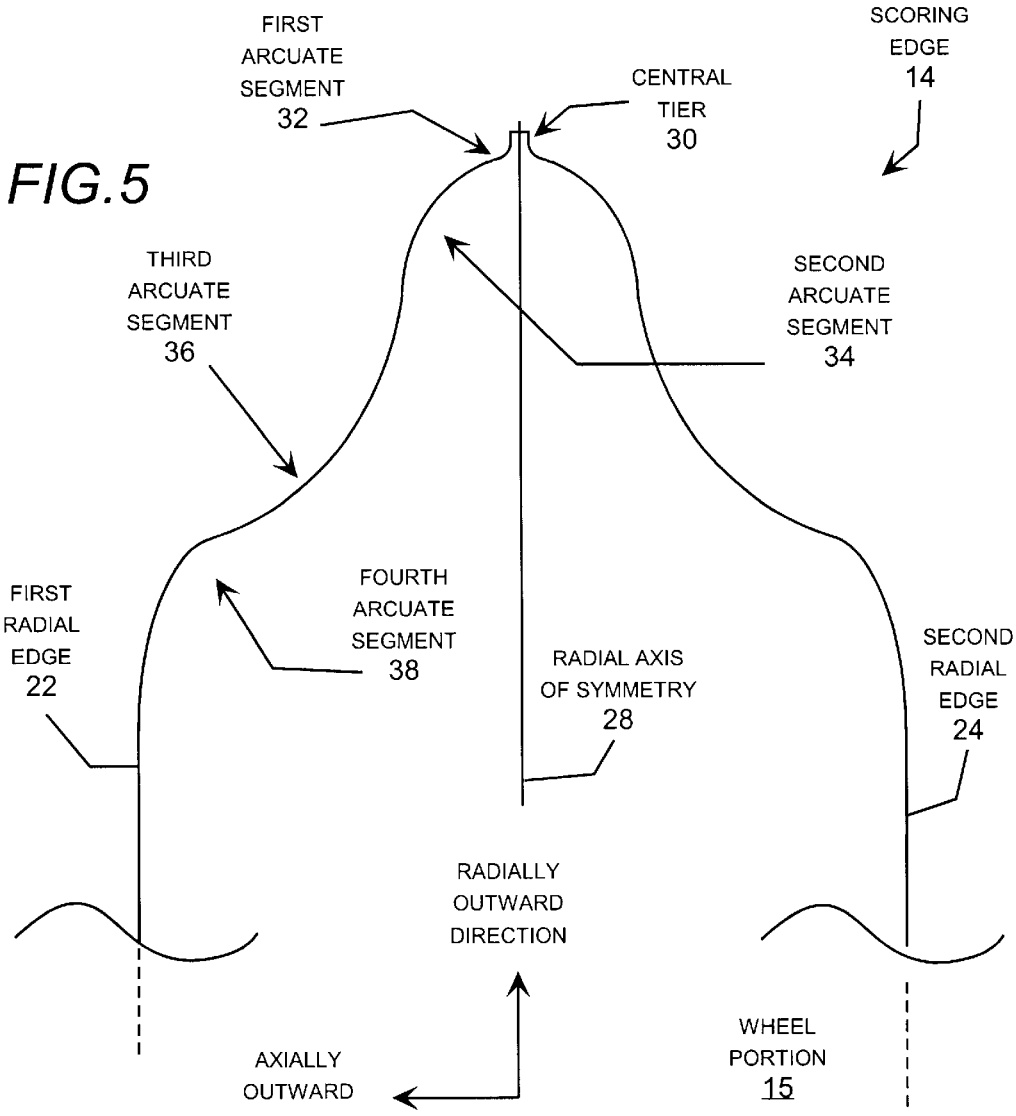
FIG. 5 is a front cross sectional view of a scoring edge scoring head having a curvilinear nib profile for impressing score lines into corrugated board.
Figure 6:
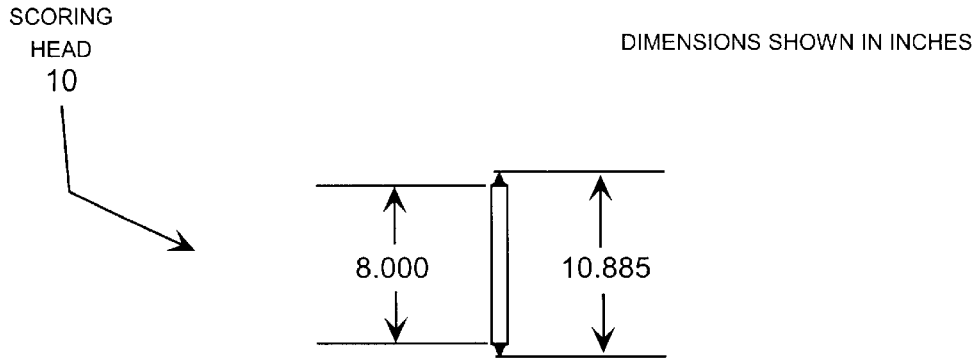
FIG. 6 is a front cross sectional view of a preferred scoring head having a curvilinear nib profile showing the height of the scoring head.
Figure 7:
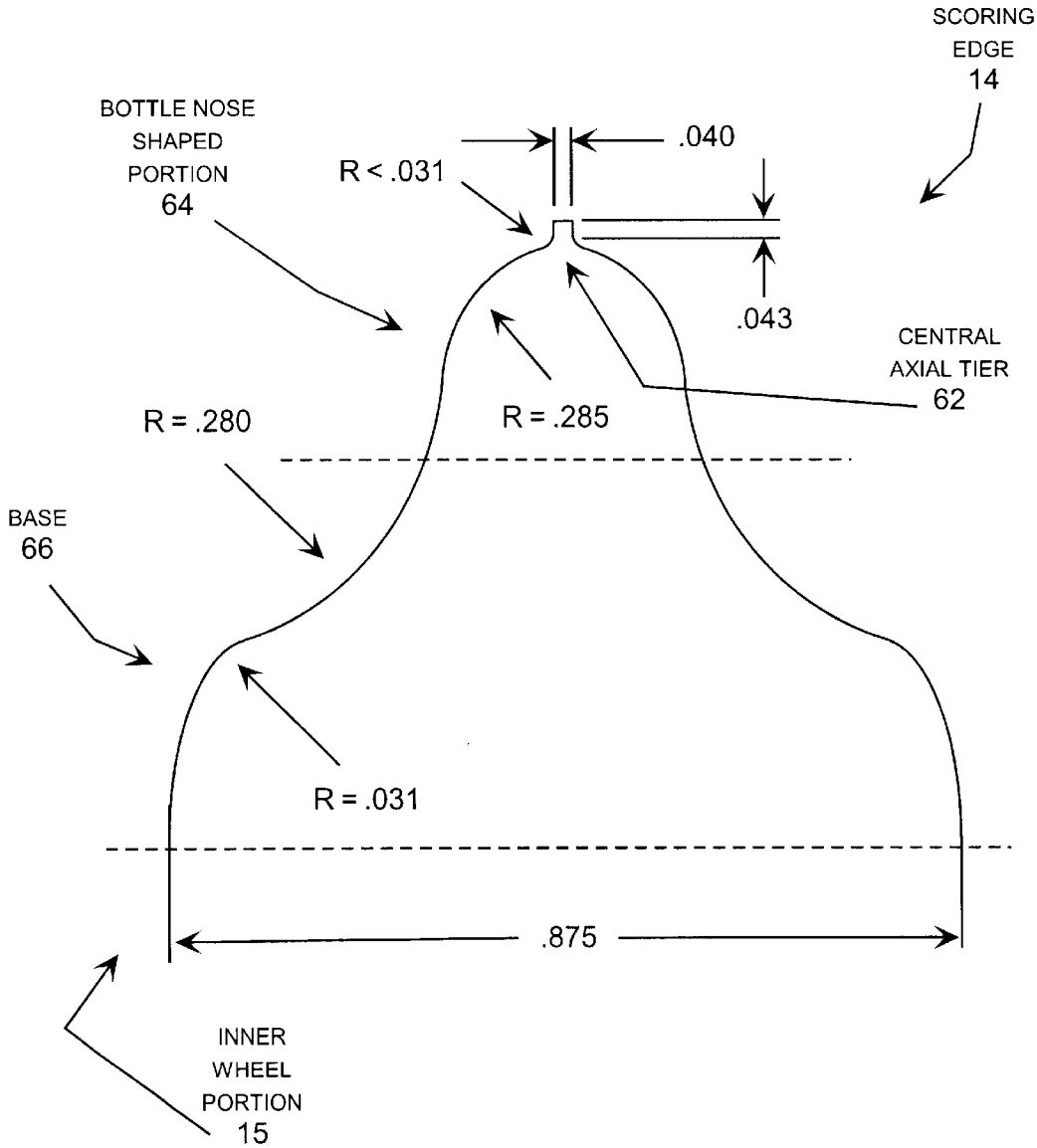
FIG. 7 is a front cross sectional view of a preferred scoring head having a curvilinear nib profile showing radial dimensions defining the scoring profile.
Figure 8A:
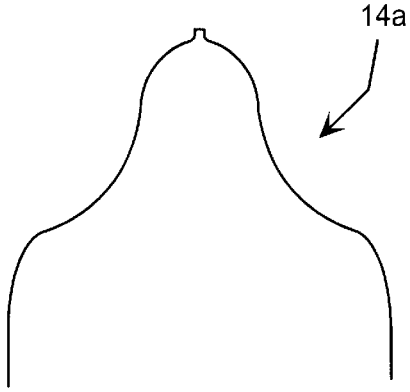
FIGS. 8A–F are front cross section views of alternative configurations for a scoring head having a curvilinear nib profile.
Figure 8B:
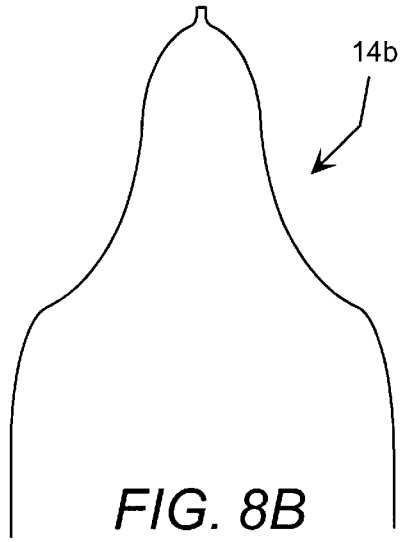
Figure 8C:
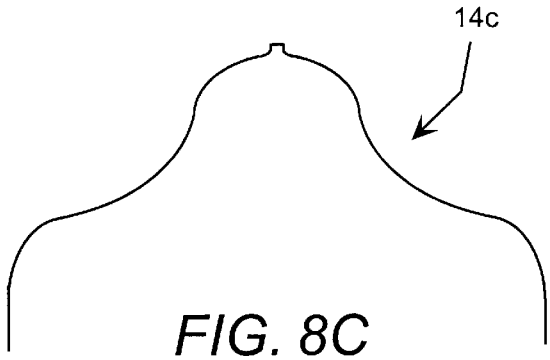
Figure 8D:
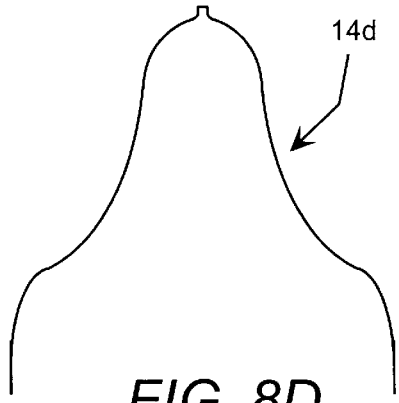
Figure 8E:
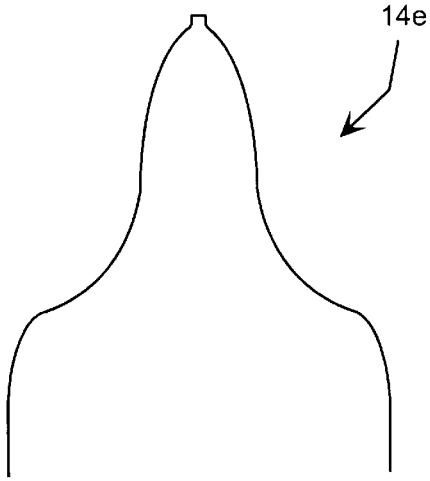
Figure 8F:
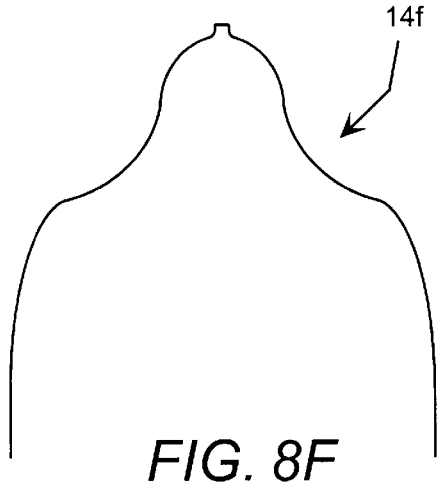
Figure 9:
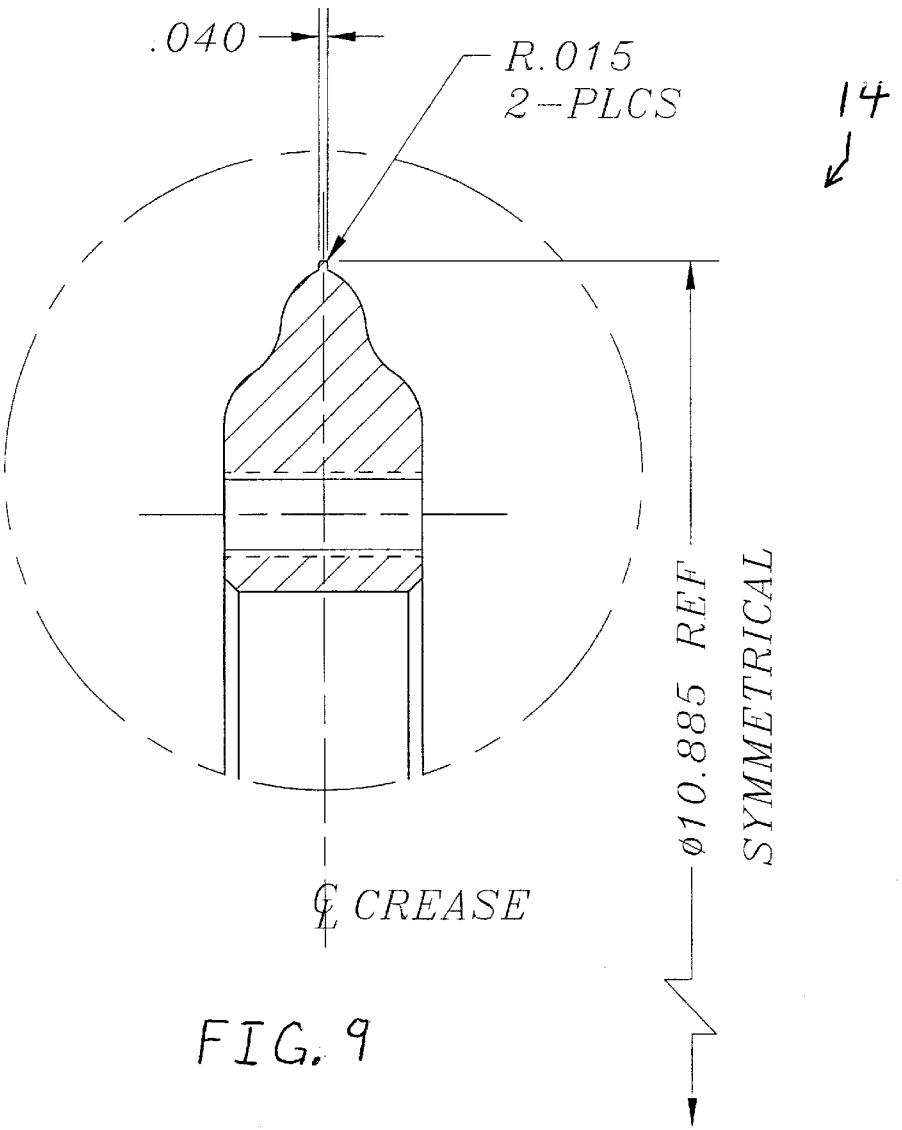
FIG. 9 is a front cross section view of a preferred configuration for a scoring head having a curvilinear nib profile showing certain dimensions.
Figure 10:
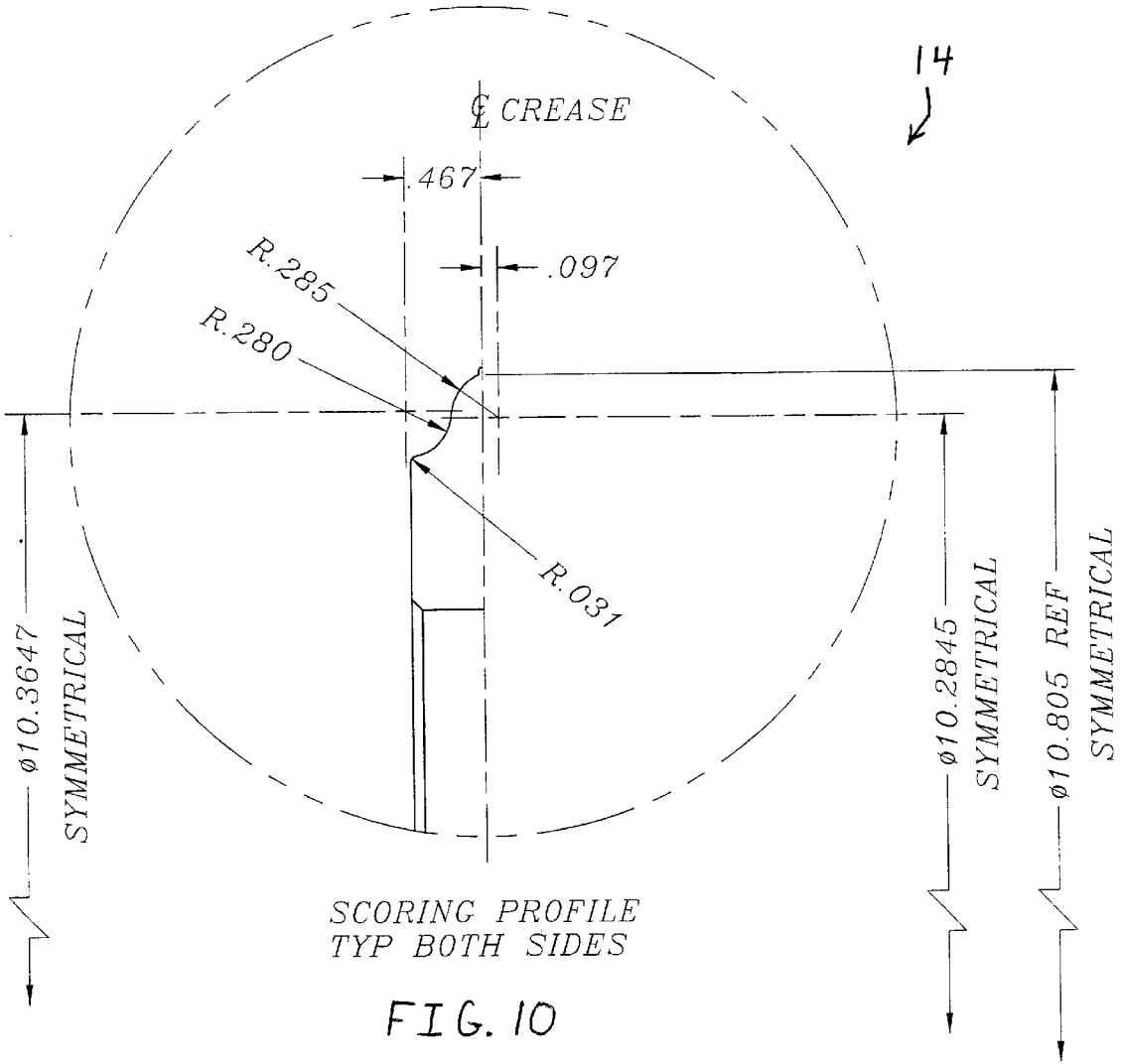
FIG. 10 is a front cross section half view of the preferred configuration for a scoring head shown in FIG. 9 showing additional dimensions.

FIGS. 5–7 are front cross sectional views of the scoring head 10 and edge 14 illustrating the inventive curvilinear nib profile and associated dimensions of a preferred embodiment. Although the preferred scoring edge profile is symmetrical about the radial axis of symmetry 28, non-symmetrical multi-tiered scoring edge profiles are contemplated within the scope of the invention. Fort example, the number, size, corner types and/or angles of the arcuate segments may be varied somewhat to produce a non-symmetrical multi-tiered scoring edge profile within the scope of the present invention. Nevertheless, the specific scoring edge profile shown in FIGS. 5–7 is the presently preferred configuration.

The scoring edge 14 includes a central tier 30 that is typically symmetrical about the radial axis of symmetry 28. The central tier 30 includes a substantially axial surface. As used in this description, an "axial surface" means a surface that is substantially perpendicular to the radial axis of symmetry 28, and includes a strictly flat perpendicular surface as well as slightly arcuate and slightly beveled surfaces that are substantially axial in nature. The central tier 30 extends from the radial axis of symmetry 28 to first and second "flanks" or substantially radial sides. As used in this description, a "flank" is a structure that includes a substantially radial surface (i.e., parallel to the radial axis of symmetry 28), and includes a strictly flat radial surface as well as slightly arcuate and slightly beveled surfaces that are substantially radial in nature. It should also be understood that the "tier" and "flank" structures may each include one or more corners or transition areas, so that the description of the tier "extending to" the flank includes a structure in which a rounded corner or other type of transition area bridges the junction from the substantially axial surface to the substantially radial surface.

In a preferred embodiment, the scoring head 10 includes an inner wheel portion 15 extending axially about an axis of symmetry 28, extending radially about an axis of rotation 26, and defining first and second radial edges 22, 24. The scoring head 10 also includes a scoring edge portion 14 located at an axially outward edge of the inner wheel portion 15 and faired into the first and second radial edges 22, 24 of the inner wheel portion. The scoring edge portion, when viewed in cross-section, includes a substantially axial tier 30 located between two substantially radial sides. The scoring edge portion also includes a curvilinear nipple shaped nib faired into the radial sides of the axial tier 30 and faired into the first and second radial edges 22, 24 of the inner wheel portion. The nib may also include a base portion 66 faired into the first and second radial edges 22, 24 and bottle nose-shaped portion 64 faired into the base.

Stated somewhat more specifically, the nib may include a first arcuate segment 32 extending about a first radius of rotation pointed in an axially inward and radially inward direction, and the radial side of the central protuberance 30 may be faired into the first arcuate segment. The nib may include a second arcuate segment 34 extending about a second radius of rotation pointed in an axially inward and radially outward direction, and the first arcuate segment 32 may be faired into the second arcuate segment 34. The nib may include a third arcuate segment 36 extending about a third radius of rotation pointed in an axially inward and radially inward direction, and the second arcuate segment 34 may be faired into the third arcuate segment 36. The nib may include a fourth arcuate segment 38 extending about a fourth radius of rotation pointed in an axially outward and radially outward direction, and the fourth arcuate segment 38 may be faired into the third arcuate segment 36 and faired into the first and second radial edges 22, 24 of the inner wheel portion.

In various embodiments, the first radius of rotation may be smaller in magnitude than the fourth radius of rotation, the first radius of rotation may be smaller in magnitude than the second and third radii of rotation, the first and fourth radii of rotation are smaller in magnitude than the second and third radii of rotation. Alternatively, the first radius of rotation may be smaller in magnitude than the fourth radius of rotation, and the fourth radius of rotation may be smaller in magnitude than the second and third radii of rotation. Or the first radius of rotation may be smaller in magnitude than the fourth radius of rotation, and the fourth radius of rotation may be smaller in magnitude than the second radius of rotation.

In a preferred embodiment, the first radius or rotation is less than 0.031 inches, the second radius or rotation is approximately 0.285 inches, the third radius or rotation is approximately 0.280 inches, and the fourth radius or rotation is approximately 0.031 inches. The height of the scoring head 10 may be approximately, 10.885 inches, and its width may be 0.875 inches. In addition, the height of the inner wheel portion may be 8.000 inches, which leaves the height of the nib at 1.44 inches around the axially outer perimeter of the inner wheel portion 15. The width of the central protuberance 30 may be approximately 0.43 inches, and its height may be approximately 0.040 inches. The scoring head may be made of any suitably hard material, such as steel or aluminum. In addition, the inner wheel portion 15 may be steel or another suitable material, and the scoring edge 14 may be constructed from another material, such as stainless steel, hardened steel, ceramic, diamond, or another suitable material. In addition, the substantially axial tier may be faired into the substantially radial sides of the central protuberance 30 at a pair of corners, each defined as an arc of approximately 90 degrees about a radius of rotation pointed in an axially outward and radially outward direction having a magnitude of 0.15 inches.

FIGS. 8A–F are front cross sectional views showing alternative curvilinear nib scoring edge profiles 14*a–h*. Any arcuate segment, fairing, tier and flank may be varied somewhat, in a symmetrical or asymmetrical configuration, to create a slightly different curvilinear nib in accordance with the present invention. Many other alternatives and alterations within the scope and spirit of the present invention will become evident to those skilled in the art.

In view of the foregoing, it will be appreciated that present invention provides a greatly improved scoring head with a curvilinear nipple shaped nib for creating crisp score lines in corrugated board of varying thickness. It should be understood that the foregoing relates only to the exemplary embodiments of the present invention, and that numerous changes may be made therein without departing from the spirit and scope of the invention as defined by the following claims.

The invention claimed is:

1. A rotating scoring head for impressing score lines in corrugated board, comprising:

an inner wheel portion;

a scoring edge portion located at an outer edge of the inner wheel portion; and wherein the scoring edge portion when viewed in cross-section defines a curvilinear nib comprising a first arcuate segment extending about a first radius of rotation pointed in an axially outward and radially outward direction faired into a second arcuate segment extending about a second radius of rotation pointed in an axially inward and radially inward direction.

2. The rotating scoring head of claim 1 further comprising a third arcuate segment extending about a third radius of rotation pointed in an axially outward and radially outward direction faired into the second arcuate surface and faired into the inner wheel portion.

3. The rotating scoring head of claim 1 wherein:

the scoring edge portion further comprises a central protuberance faired into the first arcuate segment of the nib.

4. rotating scoring head for impressing score lines in corrugated board, comprising:

an inner wheel portion;

a scoring edge portion located at an outer edge of the inner wheel portion;

wherein the scoring edge portion when viewed in cross-section comprises:

a substantially axial tier located between two substantially radial sides; and a curvilinear nib faired into the radial sides of the axial tier and faired into the inner wheel portion, the curvilinear nib comprising a first arcuate segment extending about a first radius of rotation pointed in an axially outward and radially outward direction faired into a second arcuate segment extending about a second radius of rotation pointed in an axially inward and radially inward direction faired into a third arcuate segment extending about a third radius of rotation pointed in an axially outward and radially outward direction.

5. The rotating scoring head of claim 4 wherein the nib further comprises:

a fourth arcuate segment extending about a fourth radius of rotation pointed in an axially inward and radially inward direction; and wherein the fourth arcuate segment is faired into the first arcuate segment and faired into a radial side of the axial tier.

6. The rotating scoring head of claim 5 wherein:

the first radius of rotation is larger in magnitude than the fourth radius of rotation.

7. The rotating scoring head of claim 5 wherein:

the first radius of rotation is larger in magnitude than the second and third radii of rotation.

8. The rotating scoring head of claim 5 wherein:

the third and fourth radii of rotation are smaller in magnitude than the second and first radii of rotation.

9. The rotating scoring head of claim 5 wherein:

the first radius of rotation is larger in magnitude than the fourth radius of rotation; and the fourth radius of rotation is smaller in magnitude than the second and third radii of rotation.

10. The rotating scoring head of claim 5 wherein:

the first radius of rotation is larger in magnitude than the fourth radius of rotation; and the fourth radius of rotation is smaller in magnitude than the second radius of rotation.

11. A rotating scoring head for impressing score lines in corrugated board comprising:

first and second radial edges;

a base portion faired into the first and second radial edges; and a bottle nose-shaped portion faired into the base portion and defining a first arcuate segment extending about a first radius of rotation pointed in an axially outward and radially outward direction faired into a second arcuate segment extending about a second radius of rotation pointed in an axially inward and radially inward direction; and wherein the base portion defines a third arcuate segment extending about a third radius of rotation pointed in an axially outward and radially outward direction.

12. The rotating scoring head of claim 11, further comprising a substantially axial tier located between substantially radial sides and a fourth arcuate segment extending about a fourth radius of rotation pointed in an axially inward and radially inward direction faired into the first arcuate segment and faired into a radial side of the axial tier.

* * * * *